US009500166B2

(12) United States Patent
Yoshitsune et al.

(10) Patent No.: US 9,500,166 B2
(45) Date of Patent: Nov. 22, 2016

(54) INTAKE NOISE REDUCTION DEVICE

(71) Applicant: NOK CORPORATION, Tokyo (JP)

(72) Inventors: Shuji Yoshitsune, Aso (JP); Shigeru Watanabe, Fujisawa (JP); Masahiko Inoue, Fujisawa (JP); Norimasa Hosonuma, Fujisawa (JP)

(73) Assignee: NOK CORPORATION, Tokyo (JP)

( * ) Notice: Subject to any disclaimer, the term of this patent is extended or adjusted under 35 U.S.C. 154(b) by 0 days.

(21) Appl. No.: 14/772,002

(22) PCT Filed: Feb. 28, 2014

(86) PCT No.: PCT/JP2014/055015
§ 371 (c)(1),
(2) Date: Sep. 1, 2015

(87) PCT Pub. No.: WO2014/136666
PCT Pub. Date: Sep. 12, 2014

(65) Prior Publication Data

US 2016/0010603 A1 Jan. 14, 2016

(30) Foreign Application Priority Data

Mar. 5, 2013 (JP) ..... 2013-042765
Jul. 9, 2013 (JP) ..... 2013-143486

(51) Int. Cl.
*F02M 35/12* (2006.01)
*F02D 9/10* (2006.01)

(52) U.S. Cl.
CPC ..... *F02M 35/1216* (2013.01); *F02D 9/104* (2013.01); *F02M 35/1211* (2013.01)

(58) Field of Classification Search
CPC ..... F02M 35/12
USPC ..... 181/229
See application file for complete search history.

(56) References Cited

U.S. PATENT DOCUMENTS 3,544,290 A * 12/1970 Larson, Sr. ..... F02M 27/08 123/592
4,094,290 A * 6/1978 Dismuke ..... F02M 29/04 123/593

(Continued)

FOREIGN PATENT DOCUMENTS

CN 101466939 A 6/2009
EP 0807755 A1 11/1997

(Continued)

OTHER PUBLICATIONS

Chinese Office Action dated Mar. 17, 2016.
Japanese Office Action dated Aug. 16, 2016 with English translation.
Extended European search report dated Oct. 5, 2016.

*Primary Examiner* — Forrest M Phillips
(74) *Attorney, Agent, or Firm* — Harness, Dickey & Pierce, P.L.C.

(57) ABSTRACT

Provided is an intake noise reduction device that can suppress an occurrence of noise in an intake pipe. An intake noise reduction device (100) disposed on a downstream side of a throttle valve in an intake pipe and including a flow-guiding net (110) that guides an air flow, wherein the flow-guiding net includes a mesh that is configured to be fine in a vicinity of a center of a flow passage in the intake pipe and to become coarser with distance from the vicinity of the center. For example, the mesh flow-guiding net (110) is formed of a plurality of radial portions (111) extending radially outward from the vicinity of the center of the flow passage in the intake pipe and a plurality of concentric portions (112) provided concentrically from the vicinity of the center.

5 Claims, 6 Drawing Sheets

(56) References Cited

U.S. PATENT DOCUMENTS

| | | | | |
|---|---|---|---|---|
| 5,722,357 | A * | 3/1998 | Choi | F02M 29/04 123/184.21 |
| 5,891,207 | A * | 4/1999 | Katta | B01D 46/0002 55/385.3 |
| 6,824,119 | B2 * | 11/2004 | Conley | F02D 9/1015 123/337 |
| 6,824,583 | B2 * | 11/2004 | Bulger | F02M 35/10013 123/198 E |
| 7,707,986 | B1 * | 5/2010 | Plaxton | F02M 35/10157 123/184.53 |
| 8,607,757 | B2 * | 12/2013 | Kusuda | F02M 35/10321 123/179.16 |
| 2005/0280214 | A1 | 12/2005 | Richards | |
| 2007/0241517 | A1 | 10/2007 | Olson | |
| 2009/0038880 | A1 | 2/2009 | Asada et al. | |
| 2011/0146612 | A1 | 6/2011 | Kusuda et al. | |

FOREIGN PATENT DOCUMENTS

| | | | |
|---|---|---|---|
| FR | 1008178 | A | 5/1952 |
| JP | H07208283 | A | 8/1995 |
| JP | H11-141416 | A | 5/1999 |
| JP | H11141420 | A | 5/1999 |
| JP | 2000-291452 | A | 10/2000 |
| JP | 2006-010075 | A | 1/2006 |
| JP | 2007-247547 | A | 9/2007 |
| JP | 2008-303751 | A | 12/2008 |
| JP | 2009-185729 | A | 8/2009 |
| JP | 2009-533634 | A | 9/2009 |
| JP | 2011-127507 | A | 6/2011 |
| JP | 2011-236853 | A | 11/2011 |

* cited by examiner

INTAKE NOISE REDUCTION DEVICE

CROSS-REFERENCE TO RELATED APPLICATIONS

This application is a National Stage of International Application No. PCT/2014/055015, filed Feb. 28, 2014, which claims priority to Japanese Application No. 2013-143486, filed Jul. 9, 2013 and Japanese Application No. 2013-042765, filed Mar. 5, 2013. The entire disclosures of each of the above applications are incorporated herein by reference.

FIELD

The present disclosure relates to an intake noise reduction device provided in an intake pipe to reduce intake noise.

BACKGROUND

In an intake pipe, a throttle valve is provided in order to control an intake air amount. Here, a problem arises in that noise may occur when the throttle valve is opened rapidly. A mechanism of occurrence of this noise is to be explained with reference to FIG. 10. FIG. 10 is a diagram for explaining a flow of air in the intake pipe in the beginning of the opening of the throttle valve. As shown in the figure, a throttle valve 300 is provided in an intake pipe 200. In general, the throttle valve 300 is configured to rotate around a rotating axis that is provided so as to extend in the horizontal direction. Therefore, in the beginning of the opening of the throttle valve 300, an air flow X1 through the upper side of the intake pipe 200 and an air flow X2 through the lower side thereof are created. It is considered that the noise occurs when the air flow X1 through the upper side and the air flow X2 through the lower side merge.

Conventionally, there is known a technique in which a flow-guiding net or a flow-guiding plate to guide an air flow is provided so that the occurrence of noise is suppressed (see Patent Literature 1). There is also known a technique in which a partition wall is provided so that the air flow through the upper side and the air flow through the lower side are prevented from merging (see Patent Literature 2).

However, in the case where the flow-guiding plate or the partition wall is provided, they create resistance when the air flows. Such resistance causes degradation in efficiency of air intake. On the other hand, in the case of the flow-guiding net, the resistance created during the air flow is not so large. However, in the case of the flow-guiding net according to the conventional art, although a flow-guiding function may be exhibited to a certain degree, it is difficult to sufficiently suppress the merging of the air flow X1 through the upper side and the air flow X2 through the lower side.

CITATION LIST

Patent Literature

Patent Literature 1: Japanese Patent Application Laid-Open No. H11-141420.

Patent Literature 2: Japanese Patent Application Laid-Open No. 2000-291452

SUMMARY

Technical Problem

An object of the present disclosure is to provide an intake noise reduction device that can suppress an occurrence of noise in an intake pipe.

Solution to Problem

The present disclosure adopts the following means in order to solve the problems.

That is, an intake noise reduction device of the present disclosure is an intake noise reduction device disposed on a downstream side of a throttle valve in an intake pipe and including a flow-guiding net that guides an air flow, wherein the flow-guiding net includes a mesh that is configured to be fine in a vicinity of a center of a flow passage in the intake pipe and to become coarser with distance from the vicinity of the center.

In the beginning of an opening of the throttle valve, air flowing through two places that are most distant from a rotating axis of the throttle valve are the main flows. That is, as explained in Background Art, when the rotating axis is provided so as to extend in the horizontal direction, an air flow through the upper side and an air flow through the lower side are the main flows. In the present disclosure, the mesh of the flow-guiding net disposed on the lower side of the throttle valve is configured to be fine in the vicinity of the center of the flow passage in the intake pipe and to become coarser with distance from the vicinity of the center. Accordingly, since the air tends to flow through a coarse region within the mesh, the air flow is guided such that more air flows through the region within the intake pipe that is more distant from the vicinity of the center. Consequently, it is possible to suppress the merging of the air flows through the two places. In addition, since the merging of the air flows from the two places can be suppressed by the mesh, it is possible to suppress an increase of the resistance of the flowing air more when compared to the case where the merging of the air flows from the two places is suppressed by the partition wall.

The mesh of the flow-guiding net may be formed of a plurality of radial portions extending radially outward from the vicinity of the center of the flow passage in the intake pipe and a plurality of concentric portions provided concentrically from the vicinity of the center. Note that the "concentric portion" in the present disclosure includes not only a complete circular shape but also an arcuate shape such as a semicircle.

According to such a configuration, it is possible to realize the flow-guiding net in which the mesh is configured to be fine in the vicinity of the center of the flow passage in the intake pipe and to become coarser with distance from the vicinity of the center. In addition, in the case where the flow-guiding net is configured from an elastic material, the flow-guiding net elastically deforms due to the air flow. However, a shape obtained by projecting the flow-guiding net configured as described above in a direction of the air flow changes little between before and after the deformation. Therefore, the flow-guiding function is stably exhibited. In addition, even if the flow-guiding net is configured from the elastic material, when the flow-guiding net is elastically deformed by the air flow, a uniform force acts on the radial portions, and hence a uniform force acts on the entire flow-guiding net. Therefore, the flow-guiding net is superior in durability.

The intake noise reduction device may further include an annular gasket portion that seals a gap between an end face of one pipe and an end face of another pipe, the two pipes configuring the intake pipe, wherein the flow-guiding net is provided on an inner side of the gasket portion with respect to the gasket portion.

According to such a configuration, it is possible to provide the intake noise reduction device with both of a function of reducing intake noise and a function of a gasket.

In addition, a surface of the flow-guiding net may be covered with a covering portion made of an elastic material and provided integrally with the gasket portion.

According to such a configuration, even if the flow-guiding net and the gasket portion are configured from separate members, it is possible to make a combining force of the flow-guiding net and the gasket portion sufficiently high. Consequently, it is possible to suppress the flow-guiding net from separating from the gasket portion.

The gasket portion and the covering portion may be molded by insert molding using the flow-guiding net as an insert.

According to such a configuration, it is possible to easily cover the surface of the flow-guiding net with the covering portion made of the elastic material and provided integrally with the gasket portion.

Note that the configurations described above can be adopted in combination wherever possible.

Advantageous Effects of Disclosure

As described thus far, according to the present disclosure, it is possible to suppress an occurrence of noise in the intake pipe.

DRAWINGS

DETAILED DESCRIPTION

Hereinafter, modes for carrying out the present disclosure will be exemplarily described in detail based on examples thereof with reference to the drawings. However, the dimensions, materials, shapes, relative arrangements and so on of constituent parts described in the examples are not intended to limit the scope of the present disclosure to these alone in particular unless specifically described.

First Example

Figure 1:
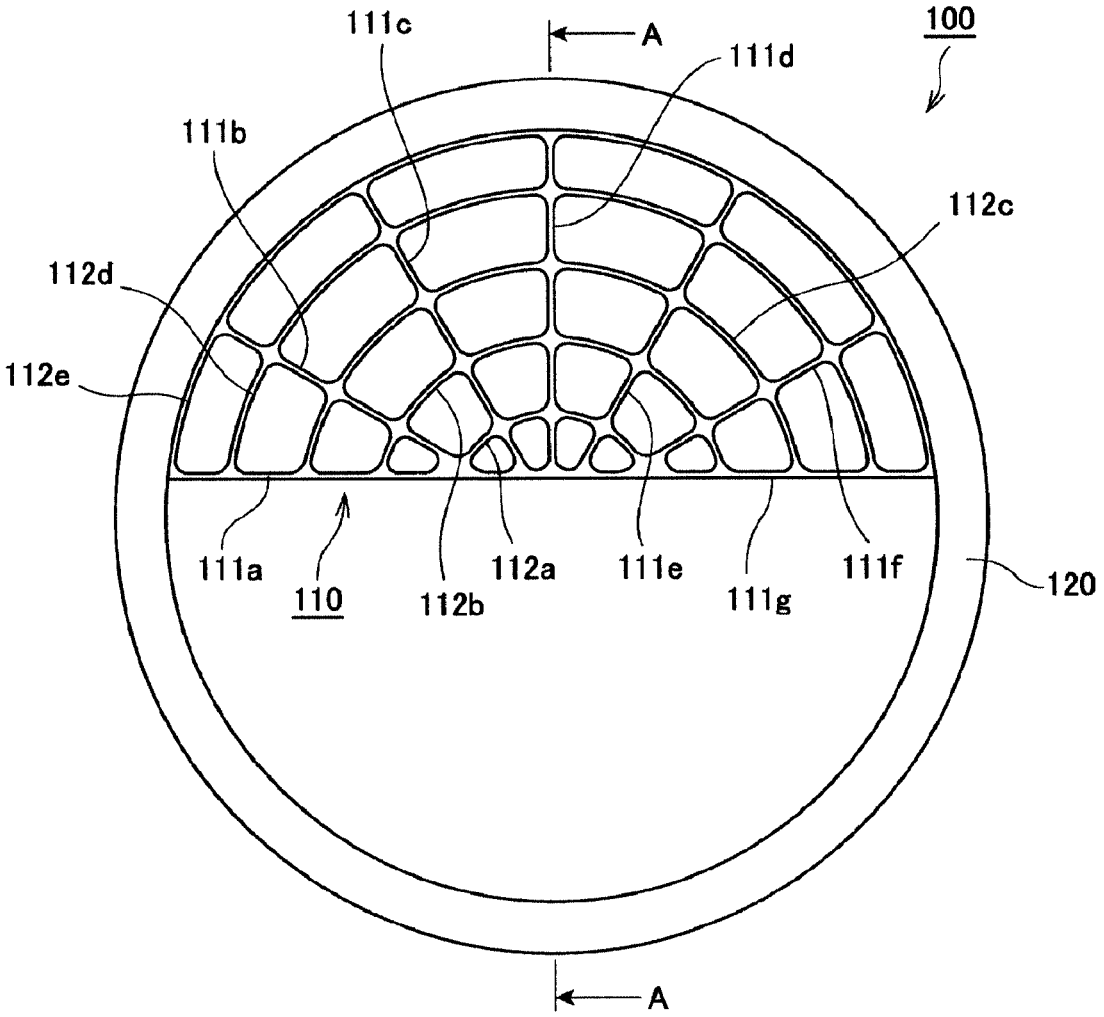
FIG. 1 is a plan view of an intake noise reduction device according to a first example of the present disclosure.

An intake noise reduction device according to a first example of the present disclosure will be described below with reference to FIGS. 1 to 3.

<Intake Noise Reduction Device>

The configuration of the intake noise reduction device according to the present example will be described with reference to FIGS. 1 and 2. FIG. 1 is a plan view of the intake noise reduction device according to the first example of the present disclosure. FIG. 2 is a schematic sectional view showing a usage state of the intake noise reduction device according to the first example of the present disclosure. Note that the intake noise reduction device shown in FIG. 2 is an AA sectional view in FIG. 1.

Figure 10:
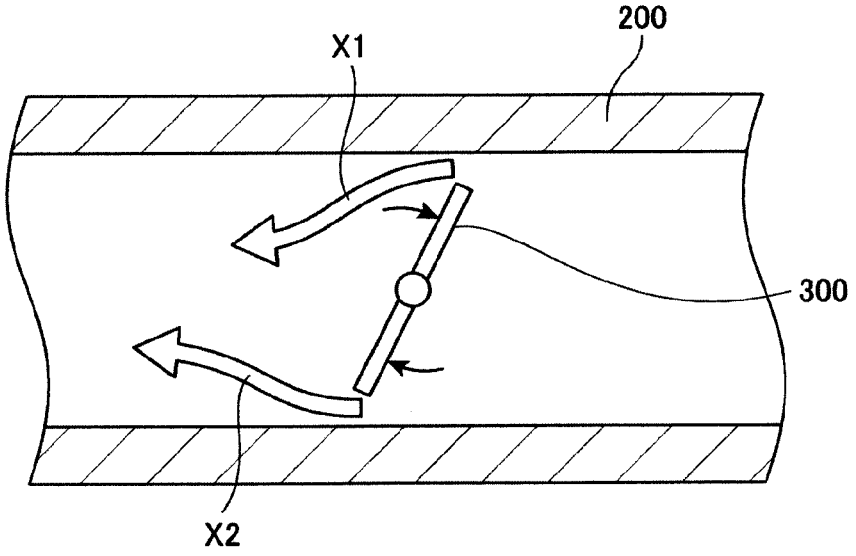
FIG. 10 is a diagram for explaining an air flow in the beginning of an opening of a throttle valve in an intake pipe.

An intake noise reduction device 100 according to the present example is disposed on a downstream side of a throttle valve 300 in an intake pipe. In addition, in the present example, the intake noise reduction device 100 is disposed in the vicinity of a connecting section between an intake manifold 210 and a throttle body 220 that constitute the intake pipe. Note that, in the present example, a rotating axis of the throttle valve 300 is provided so as to extend in the horizontal direction. The throttle valve 300 is configured to rotate in a direction shown by arrows in FIG. 2 to open a valve. With the configuration described thus far, in a state in the beginning of an opening of the throttle valve 300, an air flow through an upper side of the intake pipe and an air flow on a lower side thereof are created. This point is already explained in Background Art with reference to FIG. 10.

The intake noise reduction device 100 according to the present example is configured from a flow-guiding net 110 and a gasket portion 120. The intake noise reduction device 100 is configured from an elastic material such as various rubber materials or resin elastomers. The flow-guiding net 110 and the gasket portion 120 are integrated. However, the flow-guiding net 110 may be configured from a rigid material such as metal. In the present case, the flow-guiding net 110 and the gasket portion 120 are configured from separate members. However, for example, it is possible to integrate the flow-guiding net 110 and the gasket portion 120 by insert molding using the flow-guiding net 110 as an insert.

In the present example, a pipe of the intake pipe has a cylindrical shape. Therefore, the gasket portion 120 is formed in a circular shape. The gasket portion 120 is disposed in an annular cutout 211 formed along an inner circumference of an end face of the intake manifold 210. With this configuration, the gasket portion 120 is held between the end face of the intake manifold 210 and an end face of the throttle body 220 to exhibit a function to seal a gap between those end faces.

The flow-guiding net 110 is provided on an inner side of the gasket portion 120 with respect to the gasket portion 120. The flow-guiding net 110 is configured from a plurality of radial portions 111*a*, 111*b*, 111*c*, 111*d*, 111*e*, 111*f*, and 111*g* extending radially outward from the center of a circle of the gasket portion 120, the gasket portion having a circular planar shape, and a plurality of concentric portions 112*a*, 112*b*, 112*c*, 112*d*, and 112*e* provided concentrically from the center of the circle. A mesh is formed of the plurality of radial portions 111*a*, 111*b*, 111*c*, 111*d*, 111*e*, 111*f*, and 111*g* and the plurality of concentric portions 112*a*, 112*b*, 112*c*, 112*d*, and 112*e*. Note that, when the intake noise reduction device 100 is disposed in the intake pipe, the center of the circle of the gasket portion 120 is positioned in the vicinity of the center of a flow passage in the intake pipe. In other words, it can be said that the flow-guiding net 110 is configured from the plurality of radial portions 111*a*, 111*b*, 111*c*, 111*d*, 111*e*, 111*f*, and 111*g* extending radially outward from the vicinity of the center of the flow passage in the intake pipe and the plurality of concentric portions 112*a*, 112*b*, 112*c*, 112*d*, and 112*e* provided concentrically from the vicinity of the center of the flow passage in the intake pipe.

In the flow-guiding net 110 configured as described above, the mesh is configured to be fine in the vicinity of the center of the circle of the gasket portion 120 and to become coarser with distance from the center thereof. That is, in a state in which the intake noise reduction device 100 is disposed in the intake pipe, the mesh of the flow-guiding net 110 is configured to be fine in the vicinity of the center of the flow passage in the intake pipe and to become coarser with distance from the vicinity of the center thereof. Note that, in the present example, the plurality of radial portions 111*a*, 111*b*, 111*c*, 111*d*, 111*e*, 111*f*, and 111*g* are configured such that an angle between any two neighboring radial portions would be substantially equal. In addition, the plurality of concentric portions 112*a*, 112*b*, 112*c*, 112*d*, and 112*e* are configured such that a distance in the radial direction between any two neighboring concentric portions would be substantially equal. Accordingly, the mesh of the flow-guiding net 110 is configured such that it is fine in the vicinity of the center of the circle of the gasket portion 120 and becomes coarser with distance from the center thereof.

Figure 2:
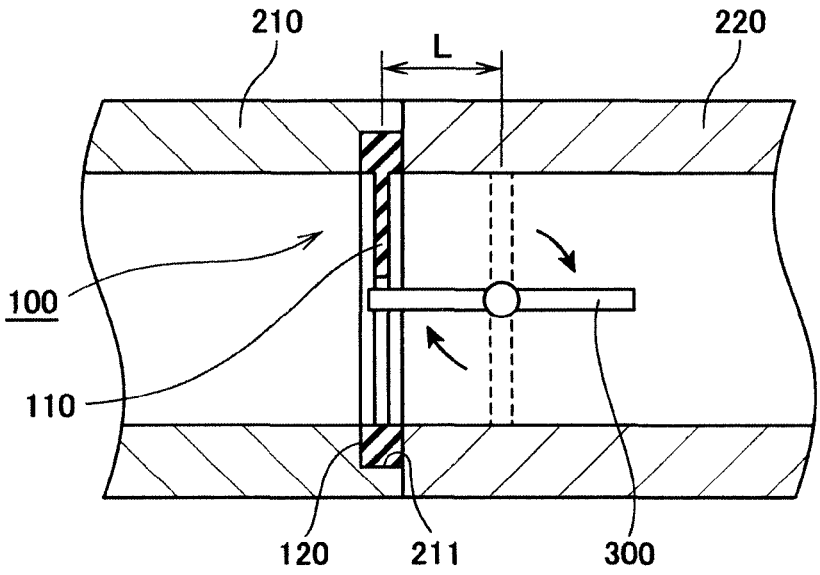
FIG. 2 is a schematic sectional view showing a usage state of the intake noise reduction device according to the first example of the present disclosure.

In the present example, as shown in FIG. 2, a distance between the throttle valve 300 and the flow-guiding net 110 is shorter than the length of a main body portion of the throttle valve 300. Thus, the flow-guiding net 110 is provided such that it occupies substantially half of a region on the inner side of the circular shaped gasket portion 120 so that the throttle valve 300 does not hit the flow-guiding net 110. Note that the remaining substantially semicircular region is a hollow. In a state in which the intake noise reduction device 100 is placed inside the intake pipe, the semicircular region provided with the flow-guiding net 110 is positioned in an upper part thereof and the hollow semicircular region is disposed in a lower part thereof. Accordingly, even in a state in which the throttle valve 300 is completely opened, the throttle valve 300 does not hit the flow-guiding net 110 (see FIG. 2).

<Advantages of the Intake Noise Reduction Device according to the Present Example>

In the beginning of the opening of the throttle valve 300, the air flowing through two places most distant from the rotating axis of the throttle valve 300 are main flows. That is, in the present example, an air flow through the upper side and an air flow through the lower side are main flows. In the intake noise reduction device 100 according to the present example, the mesh of the flow-guiding net 110 disposed on the downstream side of the throttle valve 300 is configured to be fine in the vicinity of the center of the flow passage in the intake pipe and to become coarser with distance from the vicinity of the center. Accordingly, since the air tends to flow through a coarse region within the mesh, the air flow is guided such that more air flows through the region within the intake pipe that is more distant from the vicinity of the center. However, in the present example, since the flow-guiding net 110 is disposed in the upper half region of the intake pipe, the air flow through the upper side is guided as described above. In other words, with respect to the air flowing through the upper side, the air flow that deviates toward the lower side can be reduced.

Accordingly, it is possible to suppress merging of the air flow through the upper side and the air flow through the lower side. Consequently, it becomes possible to reduce noise. In addition, since the merging of the air flows can be suppressed by the mesh, it is possible to suppress an increase of the resistance of the flowing air more when compared to the case where the merging of the air flows from the two places is suppressed by the partition wall.

In addition, with respect to the flow-guiding net 110 according to the present example, the mesh thereof is formed of the plurality of radial portions 111*a*, 111*b*, 111*c*, 111*d*, 111*e*, 111*f*, and 111*g* extending radially outward from the vicinity of the center of the flow passage in the intake pipe, and the plurality of concentric portions 112*a*, 112*b*, 112*c*, 112*d*, and 112*e* provided concentrically from the vicinity of the center.

Accordingly, it is possible to realize the flow-guiding net 110 in which the mesh is configured to be fine in the vicinity of the center of the flow passage in the intake pipe and to become coarser with distance from the vicinity of the center. In addition, in the present example, the flow-guiding net 110 is configured form the elastic material. Therefore, the flow-guiding net 110 elastically deforms due to the air flow. However, since the mesh is formed of the plurality of radial portions 111*a*, 111*b*, 111*c*, 111*d*, 111*e*, 111*f*, and 111*g* and the plurality of concentric portions 112*a*, 112*b*, 112*c*, 112*d*, and 112*e* as described above, a shape obtained by projecting the flow-guiding net 110 in a direction of the air flow changes little between before and after the deformation. Accordingly, the flow-guiding function can be stably exhibited. In addition, when the flow-guiding net 110 is elastically deformed, a uniform force acts on the radial portions 111*a*, 111*b*, 111*c*, 111*d*, 111*e*, 111*f*, and 111*g*, and hence a uniform force acts on the entire flow-guiding net 110. Therefore, the flow-guiding net 110 is superior in durability.

In addition, since the intake noise reduction device 100 according to the present example includes the gasket portion 120, the intake noise reduction device 100 exhibits both of a function of reducing intake noise and a function of a gasket.

Hereafter, an experiment result of sound pressure measurement of noise concerning various samples will be described. FIG. 3 is a graph showing sound pressure ratios of noise measured from the various samples. In this experiment, sound pressures in the beginning of the opening of the throttle valve 300 were measured using an intake pipe having an inner diameter of 66 mm. In addition, a distance L (see FIG. 2) between the throttle valve 300 and the intake noise reduction device was set to 20 mm.

Figure 3:
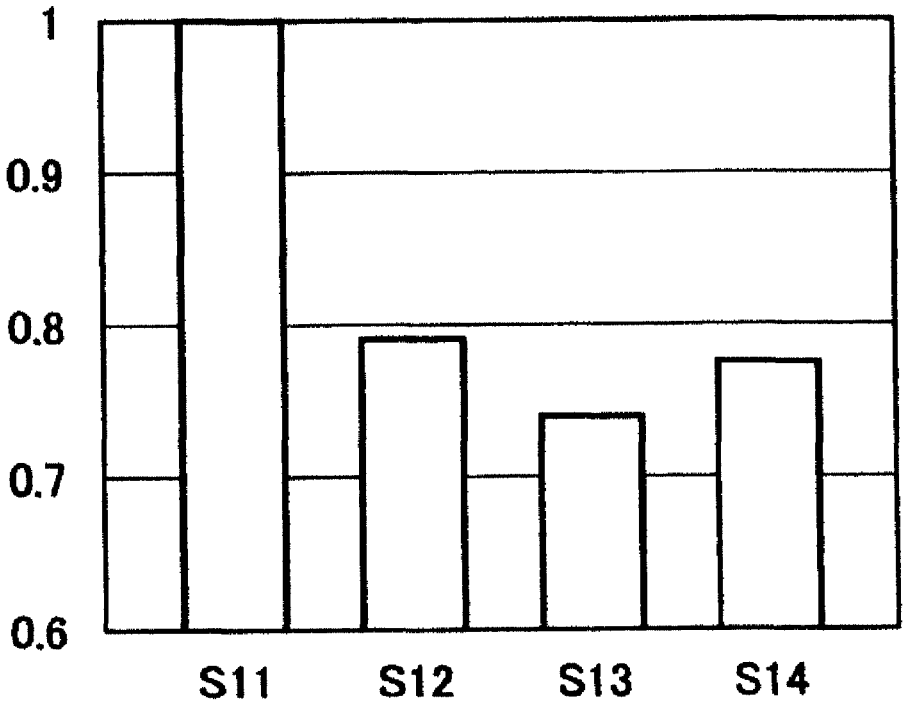
FIG. 3 is a graph showing sound pressure ratios of noise measured from various samples.

Further, in FIG. 3, the ratios of sound pressures are indicated relative to the sound pressure measured form a sample S11, which is indicated as 1, that does not have a flow-guiding net and is configured from only the gasket portion 120 having an inner diameter of 66 mm. In all of samples S12, S13, and S14, the flow-guiding net is provided in a semicircular region of an upper half of the inner side of the gasket portion 120 having the inner diameter of 66 mm.

In the case of the sample S12, a hole of a mesh of the flow-guiding net is configured in a conventional rectangular shape, and a size of each hole of the mesh is configured to be equal. More specifically, a plurality of linear portions having line width of 0.5 mm are disposed longitudinally and laterally, and they are configured such that longitudinal and lateral lengths of each hole of the mesh are 6 mm. In addition, the linear portions are configured from metal.

For the samples S13 and S14, the intake noise reduction device 100 according to the example as described above was used. However, in the sample S13, the flow-guiding net 110 is configured from metal, whereas in the sample S14, the flow-guiding net 110 is configured from rubber. The shape of the mesh (the shapes of radial portions and concentric portions) is the one shown in FIG. 1. Note that the line widths of the radial portions and the concentric portions are each 0.5 mm.

As shown in FIG. 3, it was confirmed that the noise can be suppressed most when the configuration of the intake noise reduction device 100 according to the present example is adopted and the flow-guiding net 110 is configured from metal. It was also confirmed that, by adopting the configuration of the intake noise reduction device 100 according to the present example, even when the flow-guiding net 110 is configured from rubber, the noise can be suppressed more than a conventional intake noise reduction device configured with a metal flow-guiding net.

Second Example

Figure 4:
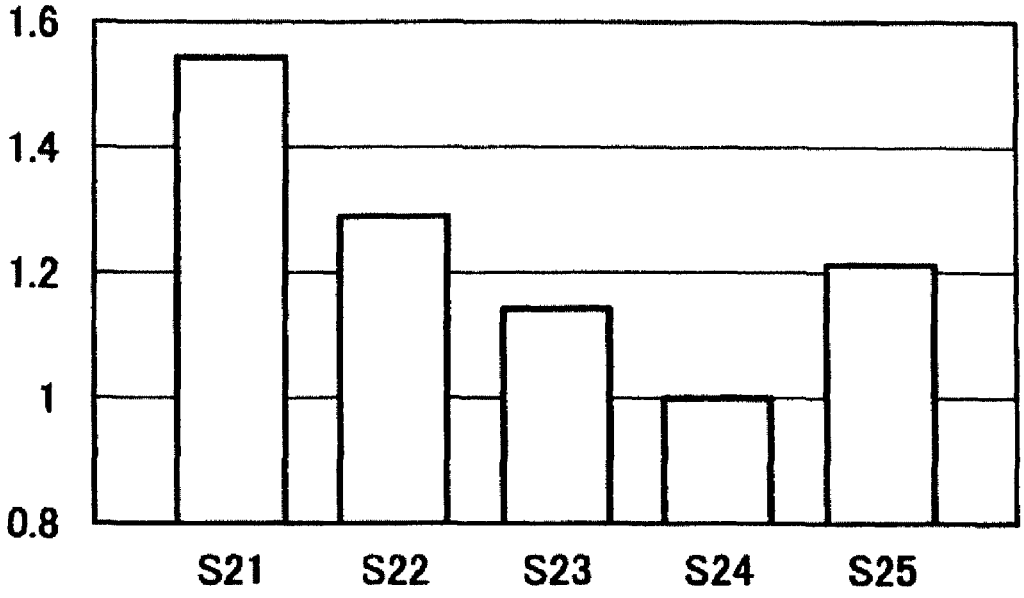
FIG. 4 is a graph showing sound pressure ratios of noise measured when a distance between a throttle valve and the intake noise reduction device is changed.
Figure 5:
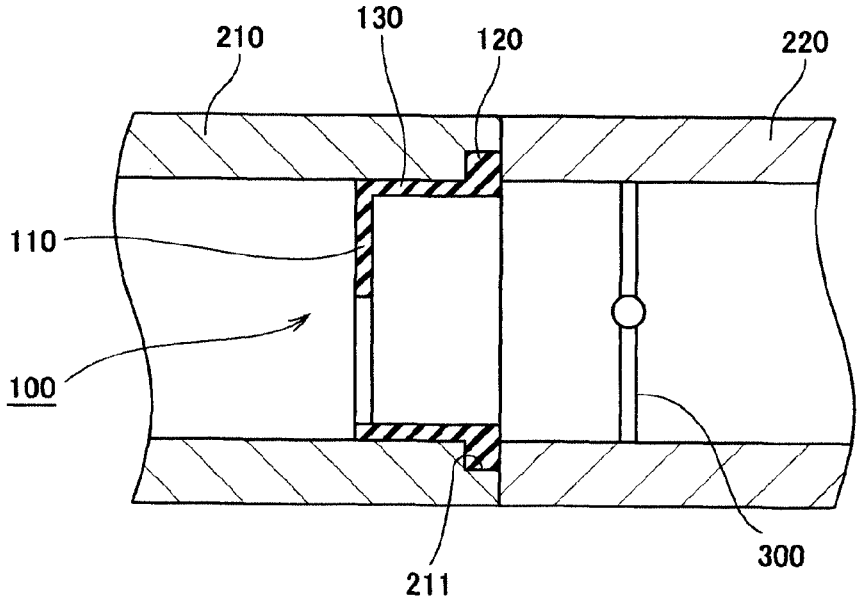
FIG. 5 is a schematic sectional view showing a usage state of an intake noise reduction device according to a second example of the present disclosure.

A second example of the present disclosure is shown in FIGS. 4 and 5. In the present example, a configuration is adopted in which a cylindrical portion is provided between a flow-guiding net and a gasket portion configuring an intake noise reduction device. Other components and their effects are the same as those in the first example, and hence the same components are denoted by the same reference numerals and the explanations thereof are omitted.

An experiment result of sound pressure measurement in the beginning of an opening of the throttle valve 300 will be described in which the intake pipe and the sample S13 that are used in the above described experiment are also used, with the distance L between the throttle valve 300 and the intake noise reduction device 100 is being changed (see FIG. 2). FIG. 4 is a graph showing sound pressure ratios of noise measured when the distance L between the throttle valve 300 and the intake noise reduction device 100 is changed.

In the graph, S21 indicates a sound pressure with the distance L of 20 mm, S22 indicates a sound pressure with the distance L of 26 mm, S23 indicates a sound pressure with the distance L of 29 mm, S24 indicates a sound pressure with the distance L of 33 mm, and S25 indicates a sound pressure with the distance L of 36 mm. The ratios of the sound pressures are indicated relative to the sound pressure measured with the distance L of 33 mm, which is indicated as 1. It has been found from the experiment result that a suppression effect of noise varies depending on the distance L between the throttle valve 300 and the intake noise reduction device 100.

Note that it goes without saying that the distance L at which noise can be suppressed most changes according to various conditions. When the intake noise reduction device 100 according to the first example is used, the distance L between the throttle valve 300 and the intake noise reduction device 100 is determined according to a location of the throttle valve 300 provided in the throttle body 220. Costs for changing the location according to various conditions would be considerably high. Therefore, in the present example, a configuration will be described in which the distance L can be changed by the intake noise reduction device 100.

FIG. 5 is a schematic sectional view showing a usage state of the intake noise reduction device according to the second example of the present disclosure. The intake noise reduction device 100 according to the present example is configured from a flow-guiding net 110, a gasket portion 120, and a cylindrical portion 130. The intake noise reduction device 100 is configured from an elastic material such as various rubber materials or resin elastomers. The flow-guiding net 110, the gasket portion 120, and the cylindrical portion 130 are integrated. The configurations of the flow-guiding net 110 and the gasket portion 120 are the same as those in the first example, and hence the explanations thereof will be omitted.

As described in the first example, the gasket portion 120 has an annular shape. Therefore, the cylindrical portion 130 connecting the gasket portion 120 and the flow-guiding net 110 has a cylindrical shape. By appropriately adjusting the length in the axial direction of the cylindrical portion 130, it is possible to adjust the distance L between the throttle valve 300 and the intake noise reduction device 100.

Note that, in the present example, the flow-guiding net 110, the gasket portion 120, and the cylindrical portion 130 are integrated. However, as described in the first example, the flow-guiding net 110 may be configured from a rigid material such as metal. In this case, the flow-guiding net 110 and the gasket portion 120 are configured from separate members. In this case, the cylindrical portion 130 may be provided integrally with the flow-guiding net 110 or may be provided integrally with the gasket portion 120. In the former case, it is possible to integrate the flow-guiding net 110 with the gasket portion 120 by insert molding using the flow-guiding net 110, with which the cylindrical portion 130 is integrally provided, as an insert. Whereas in the latter case, it is possible to integrate the flow-guiding net 110 and the gasket portion 120 via the cylindrical portion 130, which is provided integrally with the gasket portion 120, by insert molding using the flow-guiding net 110 as an insert.

Third Example

Figure 6:
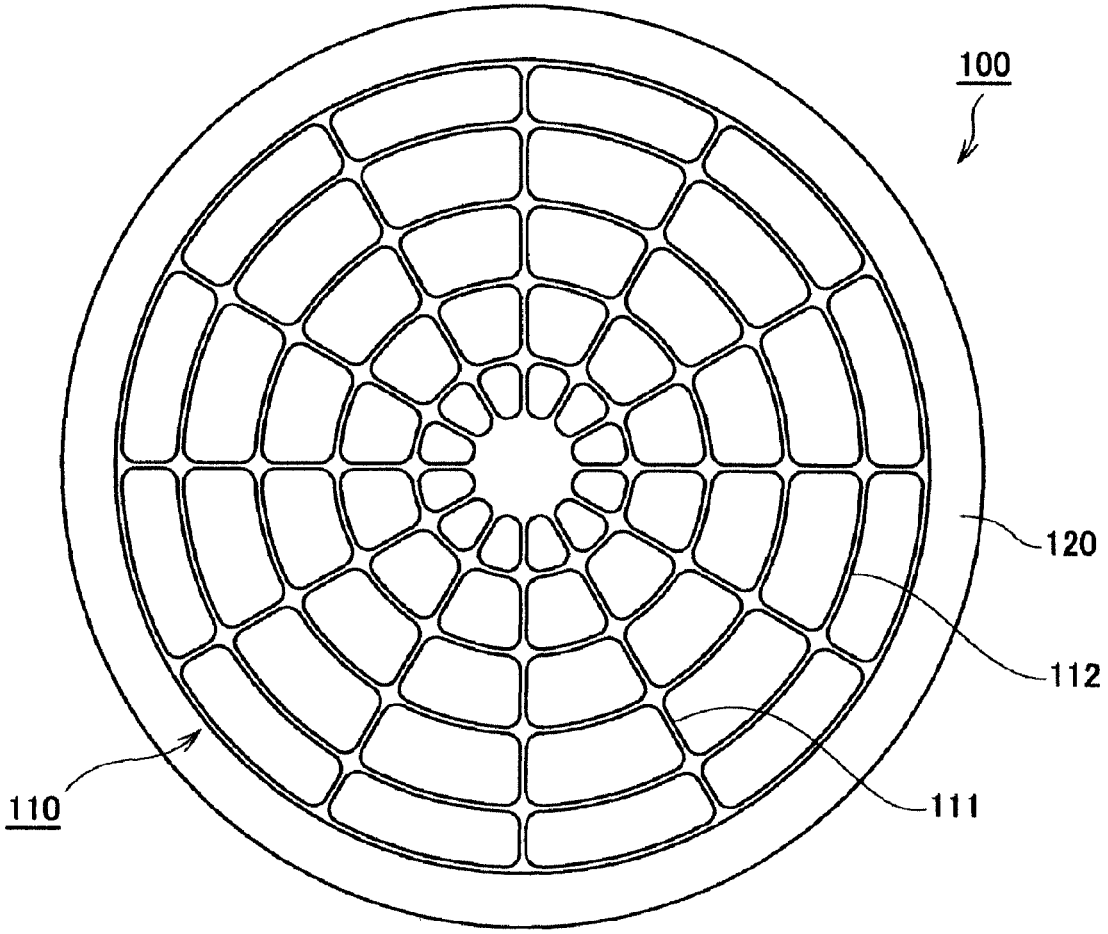
FIG. 6 is a plan view of an intake noise reduction device according to a third example of the present disclosure.

A third example of the present disclosure is shown in FIG. 6. In the first example, the flow-guiding net is provided in the substantially semicircular region on the inner side of the gasket portion. In the present example, a configuration is adopted in which the flow-guiding net is provided over an entire region on the inner side of the gasket portion. Other components and their effects are the same as those in the first example, and hence the same components are denoted by the same reference numerals and the explanations thereof are omitted.

An intake noise reduction device 100 according to the present example is also configured from a flow-guiding net 110 and a gasket portion 120, as in the case of the first example. In addition, the intake noise reduction device 100 is configured from an elastic material such as various rubber materials or resin elastomers. The flow-guiding net 110 and the gasket portion 120 are integrated. However, as described in the first example, the flow-guiding net 110 may be configured from a rigid material such as metal.

The flow-guiding net 110 in the present example is also configured from a plurality of radial portions 111 extending radially outward from the center of a circle of the gasket portion 120 having a circular planar shape, and a plurality of concentric portions 112 provided concentrically from the center of the circle, as in the case of the first example. In the case of the first example, the flow-guiding net 110 is provided to occupy substantially half of the region on the inner side of the circular-shaped gasket portion 120, whereas in the case of the present example, the flow-guiding net 110 is provided over an entire region on the inner side of the gasket portion 120. Other components are the same as the components described in the first example.

Also from the present example, the effects that are same as the effects of the first example can be obtained. In addition, in the case of the present example, since the flow-guiding net 110 is provided over the entire region on the inner side of the gasket portion 120, the air flowing through the lower side can be guided similarly to the air flowing through the upper side. Consequently, it is possible to further suppress noise. Note that the configuration of the flow-guiding net 110 according to the present example is also applicable to the intake noise reduction device 100 described in the second example.

Fourth Example

Figure 7:
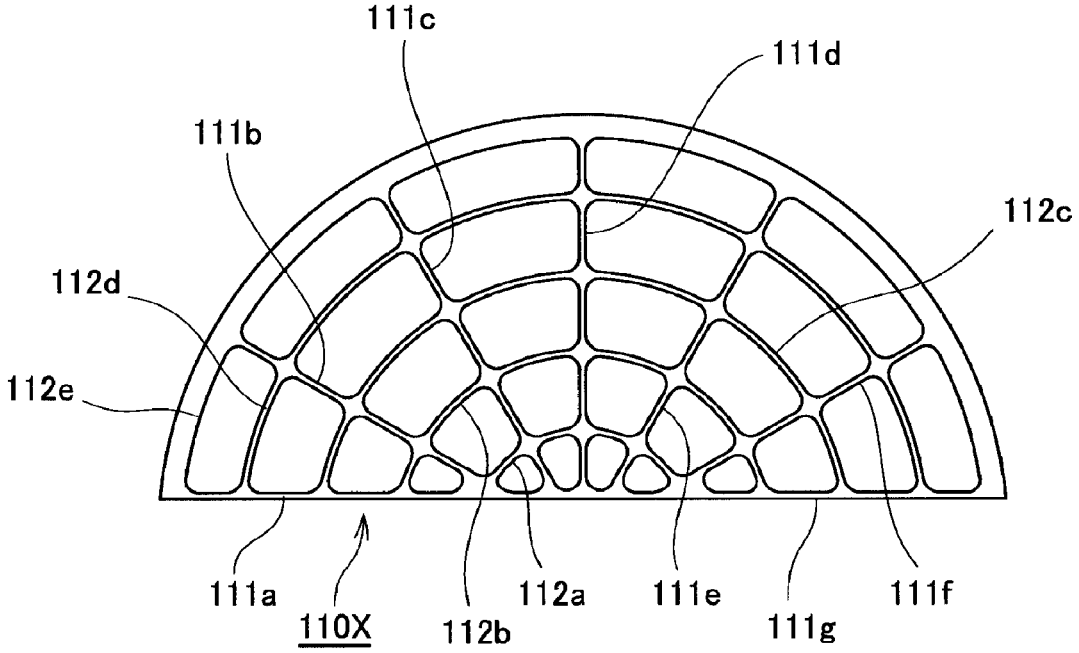
FIG. 7 is a plan view of a flow-guiding net according to a fourth example of the present disclosure.
Figure 8:
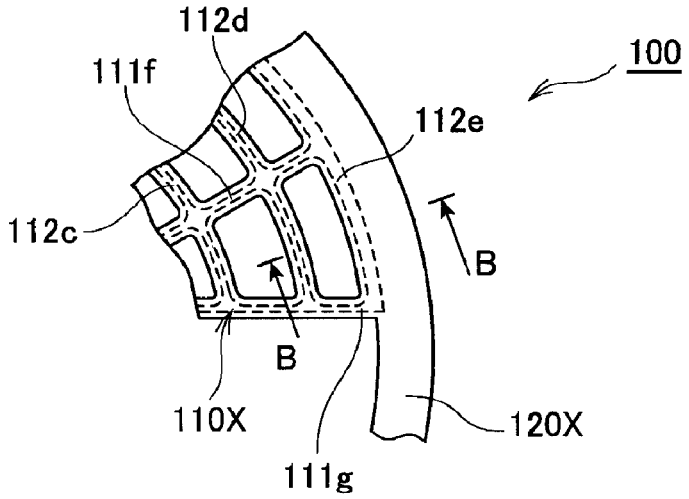
FIG. 8 is a part of a plan view of an intake noise reduction device according to the fourth example of the present disclosure.
Figure 9:
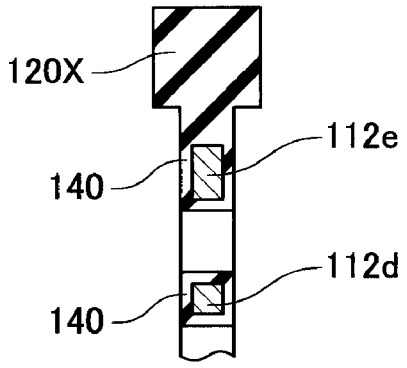
FIG. 9 is a schematic sectional view of the intake noise reduction device according to the fourth example of the present disclosure.

A fourth example of the present disclosure is shown in FIGS. 7 to 9. As described in the first example, the flow-guiding net and the gasket portion can be configured from separate members. In the present example, a preferred example is described in which the flow-guiding net and the gasket portion are configured from separate members. A basic configuration and effects are the same as those in the first example. Therefore, the same components are denoted by the same reference numerals and the explanations thereof will be omitted. Note that, in the present example, a description will be given based on an exemplified configuration in which the flow-guiding net and the gasket portion in the above described first example are configured from separate members. However, the present example is also applicable to the above described second and third examples.

FIG. 7 is a plan view of the flow-guiding net according to the fourth example. FIG. 8 is a part of a plan view of an intake noise reduction device according to the fourth example of the present disclosure and is an enlarged diagram of the part of the plan view of the intake noise reduction device. FIG. 9 is a schematic sectional view of the intake noise reduction device according to the fourth example of the present disclosure. Note that FIG. 9 is a BB sectional view in FIG. 8.

An intake noise reduction device 100 according to the present example is also configured from a flow-guiding net 110X and a gasket portion 120X, as in the cases of the above described examples. In the case of the present example, the flow-guiding net 110X and the gasket portion 120X are configured from separate members. The flow-guiding net 110X is configured from metal or a rigid resin material. Whereas the gasket portion 120X is configured from an elastic material such as various rubber materials or resin elastomers, as in the case of the above described examples In addition, in the intake noise reduction device 100 according to the present example, a surface of the flow-guiding net 110X is covered with a covering portion 140 that is made of an elastic material and provided integrally with the gasket portion 120X. Note that, in the present example, the entire flow-guiding net 110X is covered with the covering portion 140.

As described thus far, in the intake noise reduction device 100 according to the present example, the surface of the flow-guiding net 110X is covered with the covering portion 140 that is made of the elastic material and provided integrally with the gasket portion 120X. Therefore, even if the flow-guiding net 110X and the gasket portion 120X are configured from separate members, it is possible to make a combining force of the flow-guiding net 110X and the gasket portion 120X sufficiently high. Consequently, it is possible to suppress the flow-guiding net 110X from separating from the gasket portion 120X.

In addition, the intake noise reduction device 100 according to the present example can be obtained by insert molding using the flow-guiding net 110X as an insert. That is, the gasket portion 120X and the covering portion 140 are molded by insert molding using the flow-guiding net 110X as an insert. Accordingly, the surface of the flow-guiding net 110X can be easily covered with the covering portion 140 that is made of the elastic material and provided integrally with the gasket portion 120X. However, other manufacturing methods can also be employed.

Others

In each of the above described examples, the configuration is described in which the pipe of the intake pipe is configured in a cylindrical shape. Due to this, the configuration is described in which the gasket portion 120 in the intake noise reduction device 100 is configured in an annular shape. However, the intake noise reduction device according to the present disclosure can also be applied in cases where the pipe of the intake pipe is not configured in a cylindrical shape. For example, when the pipe of the intake pipe has a rectangular shape on a cross section perpendicular to the flowing direction of the air, the gasket portion 120 may be configured to have a rectangular planar shape. Note that, even in this case, with respect to the flow-guiding net 110 provided on the inner side of the gasket portion 120, the flow-guiding net 110 having a configuration similar to the configuration described in the first or third example can be used. However, in this case, concerning the plurality of concentric portions, it goes without saying that several concentric portions on the outer side may be formed in an arcuate shape rather than a semicircular shape or a circular shape.

In each of the above described examples, the configuration is described in which the mesh of the flow-guiding net 110 is formed of the plurality of radial portions extending radially outward from the vicinity of the center of the flow passage in the intake pipe, and the plurality of concentric portions provided concentrically from the vicinity of the center. This configuration is particularly effective when the flow-guiding net 110 is formed of an elastic material. However, the merging of the air flows through the two places can be suppressed as long as the mesh of the flow-guiding net is configured to be fine in the vicinity of the center of the flow passage in the intake pipe, and to become coarser with distance from the vicinity of the center. Therefore, depending on usage conditions and the like, instead of forming the mesh with the radial portions and the concentric portions as described above, the mesh may be formed of, for example, a plurality of portions extending longitudinally and laterally. In this case, instead of setting the longitudinal and lateral distances between the portions uniform, by setting the distances to become narrower toward the vicinity of the center of the flow passage in the intake pipe, it is possible to obtain the flow-guiding net in which the mesh is fine in the vicinity of the center of the flow passage in the intake pipe and becomes coarser with distance from the vicinity of the center.

REFERENCE SIGNS LIST

100: Intake noise reduction device
110, 110X: Flow-guiding net

111, 111*a*, 111*b*, 111*c*, 111*d*, 111*e*, 111*f*, 111*g*: Radial portion
112, 112*a*, 112*b*, 112*c*, 112*d*, 112*e*: Concentric portion
120, 120X: Gasket portion
130: Cylindrical portion
140: Covering portion
200: Intake pipe
210: Intake manifold
220: Throttle body
300: Throttle valve

The invention claimed is:

1. An intake noise reduction device disposed on a downstream side of a throttle valve in an intake pipe and including a flow-guiding net that guides an air flow, wherein the flow-guiding net includes a mesh that defines a plurality of concentric circular portions of increasingly larger diameter and a plurality of intersecting radial portions such that openings in the mesh are configured to be fine in a vicinity of a center of a flow passage in the intake pipe and become coarser with distance from the vicinity of the center.

2. The intake noise reduction device according to claim 1, wherein the mesh of the flow-guiding net is formed of a plurality of radial portions extending radially outward from the vicinity of the center of the flow passage in the intake pipe and a plurality of concentric portions provided concentrically from the vicinity of the center.

3. The intake noise reduction device according to claim 1, further comprising an annular gasket portion that seals a gap between an end face of one pipe and an end face of another pipe, the two pipes configuring the intake pipe, wherein the flow-guiding net is provided on an inner side of the gasket portion with respect to the gasket portion.

4. The intake noise reduction device according to claim 3, wherein a surface of the flow-guiding net is covered with a covering portion made of an elastic material and provided integrally with the gasket portion.

5. The intake noise reduction device according to claim 4, wherein the gasket portion and the covering portion are molded by insert molding using the flow-guiding net as an insert.

* * * * *